US006867174B2

(12) United States Patent
Ramirez, Jr. et al.

(10) Patent No.: US 6,867,174 B2
(45) Date of Patent: Mar. 15, 2005

(54) NON-FOAMING CLEANING COMPOSITIONS AND A METHOD FOR THEIR USE

(75) Inventors: Benjamin C. Ramirez, Jr., Englewood, NJ (US); Robert P. Micciche, Somerset, NJ (US); Uma Tripathi, Gladstone, NJ (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 10/122,500

(22) Filed: Apr. 15, 2002

(65) Prior Publication Data

US 2003/0073602 A1 Apr. 17, 2003

Related U.S. Application Data

(60) Provisional application No. 60/283,983, filed on Apr. 16, 2001.

(51) Int. Cl.[7] ..... C11D 3/24; C11D 3/43; C11D 3/395; C11D 3/39; C11D 1/14

(52) U.S. Cl. ..... 510/279; 510/278; 510/280; 510/505; 510/506

(58) Field of Search ..... 510/278, 279, 510/280, 505, 506, 432, 421; 8/137

(56) References Cited

U.S. PATENT DOCUMENTS

| | | | | | |
|---|---|---|---|---|---|
| 4,252,656 | A | * | 2/1981 | Liebowitz et al. | 510/519 |
| 4,965,063 | A | * | 10/1990 | Casey et al. | 510/100 |
| 5,514,302 | A | * | 5/1996 | Brown | 510/280 |
| 5,905,066 | A | * | 5/1999 | Zocchi et al. | 510/280 |
| 5,948,742 | A | * | 9/1999 | Chang et al. | 510/191 |
| 6,150,318 | A | * | 11/2000 | Silvester et al. | 510/284 |

* cited by examiner

*Primary Examiner*—Gregory Webb
(74) *Attorney, Agent, or Firm*—Ohlandt, Greeley, Ruggiero & Perle, LLP

(57) ABSTRACT

The present invention provides stable, non-foaming cleaning compositions having a solvent system and a surfactant system. Preferably, one composition also has a propellant system enabling the composition to be delivered as a non-foaming aerosol spray. The compositions of the present invention may also have one or more enhancing agents.

18 Claims, No Drawings

NON-FOAMING CLEANING COMPOSITIONS AND A METHOD FOR THEIR USE

RELATED APPLICATION

This application claims priority from U.S. Provisional Patent Application No. 60/283,983, filed on Apr. 16, 2001, pending.

BACKGROUND OF THE INVENTION

I. Field of the Invention

The present invention relates to cleaning compositions. More particularly, the present invention relates to aqueous, non-foaming cleaning compositions capable of removing stains from carpets, fabrics and other inanimate surfaces.

II. Description of the Prior Art

Fabric and carpet fibers may stain upon contact with water and proteinaceous materials, particulate matter, oily/greasy type soils, oxidizable materials, and numerous other materials. Such stains are conventionally removed by compositions containing combinations of cleansing surfactants that lift and remove these stains from the fabric. Stain removing compositions may also be formulated to further contain an array of enhancing agents including active oxygen-containing compounds, malodor reducing compounds, fragrances, and anti-soiling agents, commonly referred to as soil resists, that prevent or impede the re-soiling of the fabric after cleaning. One type of soil resist, a fluorosurfactant, is described in U.S. Pat. No. 5,712,240 to Tyerech et al. See also U.S. Pat. No. 5,728,669 to Tyerech. Compositions for reducing malodor impressions are described in U.S. Pat. No. 5,783,544 to Trinh et al. These include perfumes, metal salts and cyclodextrins.

In addition to providing acceptable stain removal ability, stain removal compositions must be stable for long periods of time under different conditions, and must be convenient and safe to use. Typically, a cleaning composition is delivered to a stain by way of a substrate, such as, a wipe, a cloth, or a sponge, or it is applied directly to the stain from the container in which it is housed. These containers may be adapted to spray or squirt the cleaning composition onto the stain and may also be fitted with an additional mechanical cleaning means, such as a brush or other textured surface, to aid in removing the stain.

Sprayable cleaners have been used for many years for both household and institutional cleaning of a variety of organic and inorganic soils on all types of surfaces, including textiles, hard surfaces, and other inanimate surfaces. Many of these sprayable cleaners are formulated as foaming cleaners due to the belief that the foaming action helps "lift" stains off the object or surface to be cleaned.

A number of attempts to provide fabric cleaning compositions have been made. U.S. Pat. Nos. 3,723,323 and 3,723,358 to Morgan et al. each describe aqueous fabric treating shampoo compositions containing anionic or nonionic surfactants as cleansing agents and neutralized polymers of acrylic or methacrylic acid with styrene or other unsaturated monomers such as alkyl acrylates and methacrylates. The polymer is said to impart anti-soiling properties to fabrics cleaned with the compositions.

U.S. Pat. No. 4,013,595 to Podella et al. provides non-flammable aqueous aerosol rug cleaners using hydrocarbon propellants. They possess reduced flammability due to the presence of at least 0.3% lauryl alcohol in combination with 0.3% to 10% of an alkali metal lauryl sulfate salt as at least one of the surfactants. The Podella et al. compositions also contain polymers of the type taught in the Morgan et al. patents noted above.

U.S. Pat. No. 3,734,686 to Douglas provides a carpet cleaning shampoo composition for carpets and pile fabrics, which claims to enhance the abrasion resistance and anti-static properties of the treated carpet or pile fabric. This benefit comes from the presence of an aqueous emulsion of oxygen-free polyethylene of particle size 0.02 to 0.5 microns and average molecular weight of 7,000 to 40,000 where at least 30% of the particles are covered with an emulsifier composition. This patent states that the composition possesses increased foaming action and that less force is needed to apply the shampoo to the carpet.

U.S. Pat. No. 4,304,610 to Weisensel provides a carpet cleaning method for use with extraction machinery to clean carpets that contain high foaming anionic surfactants. The aqueous liquid or dry powder composition contains a cationic surfactant that reacts with and suppresses foaming of the anionic surfactant in the carpet, a nonionic surfactant as a primary cleaning agent, builders, fillers and chelating agents, and optionally, optical brighteners, dyes and perfumes.

U.S. Pat. No. 4,561,992 to Troger et al. provides an aerosol cleaning agent for textile surfaces that contains plasticized urea-formaldehyde resin foam particles (0.005–0.120 mm), propellant, anti-settling agent, suspending agent, a liquid, and sodium aluminum silicate particles. A silicone defoamer may be included to promote the removal of soap residue. The product is applied to textile upholstery, allowed to dry and vacuumed away from the fabric.

U.S. Pat. No. 4,678,595 to Malik et al. provides a carpet shampoo or upholstery cleaning composition containing a glycoside surfactant, a normally solid, water-soluble or water dispersible polymer component and water. Optionally, antistatic agents, foam builders and stabilizers, such as, amine oxides and amphoteric cycloimidines or imidazolines, optical brighteners, perfumes and the like can also be included.

U.S. Pat. No. 4,780,100 to Moll provides a foaming aqueous aerosol fabric cleaning composition, which has foaming surfactants, solvents, propellants, builders and water. The foam arguably enters the fabric pile and brings dirt up to the surface as a second foam is formed when the solvent evaporates. The only requirement for surfactants is that they form a foam and can include organosilicones. Amphoteric surfactants such as betaines can be used.

The following further represent the state of the art. Additional carpet, textile, and fabric cleaning compositions are provided in U.S. Pat. No. 5,514,302 to Brown; U.S. Pat. No. 5,922,665 to Liu; U.S. Pat. No. 5,948,743 to Fonsny et al.; and U.S. Pat. No. 6,048,368 to Tcheou et al.

While sprayable foaming cleaning compositions are well known in the art, they are not without disadvantage. Foams may contain at least 15% to about 30% air, which can result in an incomplete product to stain surface contact and subsequent cleaning ineffectiveness. Moreover, foam, when not completely removed from the surface being cleaned, can form a residue, which is not only visually undesirable, but requires additional cleaning to remove the residue.

Moreover, due to environmental air quality concerns, strict laws regulating the use of chemicals, such as solvents in cleaning solutions, that emit volatile organic compounds (VOC's), are in place. As a result, many current cleaning compositions with these solvents will require either discontinuance or drastic reformulation to meet the stringent VOC regulations. Without the use of these well known and effective solvents, current cleaning compositions may be ineffective.

To overcome these and other disadvantages, the cleaning composition of the present invention is a stable, non-foaming aerosol composition, capable of removing stains on carpets, fabrics, and other inanimate objects. In addition, the compositions of the present invention are uniquely formulated to not only have superior stain removal properties, but to also comply with environmental regulations directed to VOC's.

SUMMARY OF THE INVENTION

It is an object of the present invention to provide cleaning compositions capable of removing stains from carpets, fabrics, and other inanimate objects.

It is another object of the present invention to provide such cleaning compositions that are non-foaming upon application to the surface to be cleaned.

It is still another object of the present invention to provide such cleaning compositions that are delivered as a non-foaming aerosol spray.

It is yet another object of the present invention to provide such cleaning compositions that comply with environmental regulations directed to volatile organic compounds.

It is a further object of the present invention to provide a method for cleaning a stain from a carpet, fabric, or other inanimate object using the non-foaming cleaning compositions of the present invention.

To accomplish the foregoing objectives and advantages, the present invention, in brief summary, is a stable, non-foaming cleaning composition comprising: a solvent system and a surfactant system. In one embodiment of the present invention, the composition further includes a propellant system enabling the composition to be delivered as a non-foaming aerosol spray. The present invention may also include one or more enhancing agents. The present compositions are not only effective in removing stains, they are compliant with environmental regulations for VOC's.

DETAILED DESCRIPTION OF THE INVENTION

The present invention provides stable, aqueous, non-foaming cleaning compositions. Preferably, a cleaning composition of the present invention has a solvent system and a surfactant system. Still further, the cleaning composition may have one or more enhancing agents. Such enhancing agents include, but are not limited to, one or more preservatives, fragrances, malodor reducing systems, pH control agents, peroxygen components, soil resists, or any combinations thereof.

The aqueous cleaning composition of the present invention has a solvent system that aids in the removal of stains. Preferably, the solvent system includes one or more organic solvents that are not only effective at removing stains, but are present in an amount that complies with environmental regulations directed to VOC's.

Suitable organic solvents include, but are not limited to, one or more halogenated hydrocarbons, hydrocarbons, glycols, ethylene glycols, glycol ethers, propylene glycols, propylene glycol methyl ethers, propylene glycol butyl ethers, dipropylene glycols, dipropylene glycol methyl ethers, tripropylene glycols, tripropylene glycol methyl ethers, diethylene glycol butyl ethers, methanols, ethanols, propanols, isopropanols, n-butanols, sec-butanols, tert-butanols, hexylcellosolves, butylcellosolves, methylcellosolves, aromatic hydrocarbons, esters, glycol ether esters, ketones, plasticizers, or any combinations thereof.

Preferably, the solvent system includes one or more of the following organic solvents: propylene glycol monomethyl ether, propylene glycol t-butyl ether, diethylene glycol monobutyl ether, isopropanol, or any combinations thereof.

The solvent system is present in the cleaning composition in an amount about 2 percent by weight (wt. %) to about 60 wt. % of the total weight of the composition. Preferably, the solvent system is present in an amount about 10 wt. % to about 50 wt. %, and more preferably about 15 wt. % to about 45 wt. %, of the total weight of the aerosol cleaning composition.

The cleaning composition of the present invention also has a surfactant system. The surfactant system has one or more surfactants in an amount sufficient to remove stains, yet avoid foaming. These surfactants are preferably mild surfactants. Such surfactants may be anionic, cationic, nonionic, zwitterionic, amphoteric, or any combinations thereof.

Preferably, the surfactant system of the present invention has one or more nonionic surfactants, amphoteric surfactants, or any combinations thereof.

Suitable nonionic surfactants that can be used in the cleaning compositions of the present invention include, but are not limited to, one or more ethoxylated (EO), propoxylated (PO), inter-dispersed ethoxylated-propoxylated (EO-PO), alcohols, copolymers, fatty acids, alkyl phenols, polyglycosides, n-alkylpyrrolidones, block copolymers, or any combinations thereof. The most preferred nonionic surfactants are EO, PO, and EO-PO alkyl phenols, or any combinations thereof. Most preferably, the nonionic surfactant is nonyl phenol ethoxylate.

Suitable amphoteric surfactants include, for example, one or more betaines, amine oxides, alkyl imidazolines, cocaamphopropionates, or any combinations thereof. Preferably, the amphoteric surfactant is an alkylhydroxypropylsultane sold under the tradename BURCO® HCS-989-DF by Burlington Chemical Company, Inc.

The surfactant system is present in the cleaning composition in an amount about 0.001 wt. % to about 2 wt. % of the total weight of the cleaning composition. Preferably, the surfactant system is present in an amount about 0.005 wt. % to about 1 wt. %, and more preferably about 0.01 wt. % to about 0.5 wt. %, of the total weight of the cleaning composition.

The cleaning compositions of the present invention are aqueous compositions. Preferably, the compositions include water, which is present in an amount about 35 wt. % to about 95 wt. % of the total weight of the composition. More preferably, the water is present in an amount about 40 wt. % to about 75 wt. % of the total weight of the composition.

Preferably, the cleaning compositions of the present invention also include one or more enhancing agents. These enhancing agents improve the stability, efficacy, ease, and/or pleasure of use by the end user. The one or more enhancing agents that can be used in the present cleaning compositions include, but are not limited to, one or more preservatives, fragrances, malodor reducing agents, salts, pH control agents, peroxygen components, soil resists, or any combinations thereof.

Suitable preservatives include, but are not limited to, one or more organic salts, organic sulfur compounds, halogenated compounds, cyclic organic nitrogen compounds, low molecular weight aldehydes, quaternary compounds, phenyl and phenoxy compounds, parabens, organic acids and derivatives, iodophors, quaternary ammonium compounds, urea derivatives, isothiazolines, alkyl substituted amino acids, formaldehydes, formaldehyde donors including 1-(3-chloroallyl)-3,5,7-azoniaadamantane chloride, 1,3-bis(hydroxymethyl)-5,5-dimethylhydantoin, 1-(hydroxymethyl)-5,5-dimethyl hydantoin, 3-iodo-2-propynyl butyl carbamate, hexahydro-1,3,5-tris(2-hydroxyethyl)-s-triazine, or any combinations thereof. Preferably, the preservative is an organic salt, such as, for example, sodium benzoate.

When a preservative is present, it is present in an amount about 0.001 wt. % to about 2 wt. % based on the total weight of the composition. Preferably, the preservative is present at about 0.01 wt. % to about 1 wt. %, with about 0.05 wt. % to about 0.5 wt. % being the most preferred amount.

One or more fragrances may be used in the present cleaning compositions to eliminate the chemical smell inherent with cleaning compositions. Also, the fragrance may mask or eliminate any odors associated with the stain being cleaned.

Suitable fragrances include, but are not limited to, one or more aromatic or aliphatic esters having a molecular weight from about 130 to about 250, aliphatic or aromatic alcohol having a molecular weight from about 90 to about 240, aliphatic ketone having a molecular weight from about 150 to about 260, aromatic ketone having a molecular weight from about 150 to about 270, aromatic and/or aliphatic lactone having a molecular weight from about 130 to about 290, aliphatic aldehyde having a molecular weight from about 140 to about 200, aromatic aldehyde having a molecular weight from about 90 to about 230, aliphatic or aromatic ether having a molecular weight from about 150 to about 270, condensation product of aldehyde and amine having a molecular weight from about 180 to about 320, or any combinations thereof.

When present, the one or more fragrances are present in an amount about 0.001 wt. % to about 2 wt. % of the total weight of the composition. Preferably, the fragrance is present in an amount about 0.05 wt. % to about 1 wt. %. The more preferred amount of fragrance is about 0.1 wt. % to about 0.5 wt. % of the total weight of the composition.

One or more malodor reducing agents may be used in the cleaning composition of the present invention. Useful malodor reducing agents include, but are not limited to, one or more cyclodextrins, inorganic and organic acids, metallic salts of inorganic and organic acids, enzymes or enzyme systems, metazenes, or any combinations thereof.

One or more peroxygen compounds may be used in the present invention to enhance cleaning properties of the compositions. Suitable peroxygen compounds include, but are not limited to, hydrogen peroxides, t-butyl hydroperoxides, sodium or other salts of percarbonates, sodium or other salts of perborates, or any combinations thereof.

One or more pH control agents may be used in the present invention. Suitable pH control agents include, but are not limited to, one or more inorganic acids, inorganic bases, salts of inorganic acids, organic acids, organic bases, salts of organic acids, phosphorous compounds, or any combinations thereof.

The pH range of the cleaning composition is about 4 to about 12. The more preferred pH range is about 6 to about 10, with the most preferred being about 6.5 to about 9.

The cleaning composition of the present invention may also have one or more soil resists. The soil resist may be, for example, polymeric or copolymeric. Suitable polymeric or copolymeric soil resists include, but are not limited to, one or more polymers derived from styrene-maleic anhydride copolymer resins, monomers of acrylic acids, methacrylic acids, methacrylates, methylmethacrylates, ethyl acrylates, maleic acids, copolymers derived from the above monomers, and any combinations thereof. Still others may include, but are not limited to, one or more polyvinylpyrrolidones, polyacrylates, modified cellulose polymers, polycarboxylates, vinyl acetate/maleic anhydride copolymer resins, cationic amines, aliphatic quaternary ammonium salts known to have anti-static properties, imidazoline salts, fluoroaliphatic oligomer or polymers, fluorinated hydrocarbon soil resists such as the Zonyl® series from DuPont, fluorinated acrylate copolymers, or any combinations thereof.

As described above, the cleaning compositions are formulated to be non-foaming when dispensed and/or applied to a stain. As such, the cleaning compositions of the present invention may be contained in any suitable packaging or containers known to those in the art. These packages or containers may include, for example, bottles, such as spray or squirt bottles, aerosol canisters, substrates such as wipes or sponges, and/or barrier-type packages.

In a preferred embodiment of the present invention, the non-foaming cleaning compositions are packaged in an aerosol canister and are capable of being delivered to a stained article as a non-foaming spray. When packaged as an aerosol, the compositions of the present invention include a propellant system. The propellant system may include, for example, propellants, such as, hydrocarbons and/or inorganic gases. Suitable hydrocarbon propellants include, for example, methane, ethane, n-propane, n-butane, isobutane, n-pentane, isopentane, or any mixtures thereof. Suitable inorganic gas propellants include, for example, carbon dioxide, nitrogen, nitrous oxide, or any combinations thereof.

When the cleaning compositions of the present invention are formulated as aerosol compositions, the propellant system is present in an amount about 5 wt. % to about 10 wt. % of the total weight of the aerosol composition. Preferably, the propellant system is present in an amount about 7 wt. % to about 9 wt. % of the total weight of the aerosol composition.

To remove a stain on a carpet, fabric, or other inanimate object, the cleaning composition of the present invention is first applied to the stain. The method by which the cleaning composition is applied will vary with the type of package or container that houses the cleaning composition. Once the cleaning composition is applied to the stain, the consumer uses a substrate like a towel, cloth, and/or sponge to blot, dab, and/or rub the stained area to remove the stain. While it is apparent from the test data set forth below that the compositions of the present invention are effective at removing stains after one or two applications, the cleaning procedure may be repeated until the consumer is satisfied with the level of stain removal.

Non-foaming cleaning compositions of the present invention were formulated with the following chemical constituents in amounts expressed as percent by weight of the total weight of cleaning composition.

Option #1 Cleaning Composition

| Chemical Name | Trade Name | Concentrate % | Aerosol % |
|---|---|---|---|
| DI Water | DI Water | 71.45 | 65.74 |
| Sodium Benzoate | Sodium Benzoate | 0.2 | 0.18 |
| Amphoteric Surfactant | Burco HCS-989-DF* | 0.2 | 0.18 |
| Propylene Glycol Monomethyl Ether | Arcosolv PM/Dowanol PM | 10 | 9.2 |
| Propylene Glycol t-butyl Ether | Arcosolv PTB | 8 | 7.36 |
| Diethylene Glycol Monobutyl Ether | Butyl Carbitol / Dowanol DB | 10 | 9.2 |
| Fragrance | Fragrance | 0.15 | 0.14 |
| Hydrocarbon Propellant A-46 | A-46 | — | 8 |
| TOTAL | | 100 | 100 |

*Proprietary material (55% active) (50% Trade Secret, 5% Proprietary Surfactant)

Option #2 Cleaning Composition

| Chemical Name | Trade Name | Concentrate % | Aerosol % |
|---|---|---|---|
| DI Water | DI Water | 51.73 | 47.6 |
| Sodium Benzoate | Sodium Benzoate | 0.33 | 0.3 |
| Nonyl Phenol Ethoxylate | Igepal CO-630 / Cedepal CO-630 | 0.33 | 0.3 |
| Isopropyl Alcohol | Isopropyl Alcohol | 18.15 | 16.7 |
| Diethylene Glycol Monobutyl Ether | Butyl Carbitol / Dowanol DB | 29.13 | 26.8 |
| Fragrance | Fragrance | 0.33 | 0.3 |
| Hydrocarbon Propellant A-46 | A-46 | — | 8 |
| TOTAL | | 100 | 100 |

The following examples of stain removal performance illustrate the effectiveness of the cleaning compositions of the present invention when used to remove stains from carpets and fabrics.

EXAMPLE 1

Product Consumer Testing

The performance and consumer response of Option 1 cleaning composition and Option 2 cleaning composition were evaluated as new products for removing spots and stains from carpets and fabrics. The product testing group employed a total of 200 people from their database to participate in these studies. Women in the studies were people who clean spots and stains from their carpets, and who have done so within the last 3 months. Two monadic tests were performed, one for each product. One hundred panelists were in each test. Each product was positioned as an aerosol Carpet Spot & Stain Remover. Both formulations were placed in white 12 oz. aluminum cans equipped with an Accusol Trigger. Each product was used for a total of two weeks by each panelist in the test. The results of the tests are set forth in Tables 1 through 3 below.

TABLE 1

Consumer Testing Results for Option 1 and Option 2 Cleaning Compositions

| | Option #1* Top Box/Top 2 Box | Option #2* Top Box/Top 2 Box |
|---|---|---|
| Cleaning | | |
| Cleans well overall | 78/89 | 62/84 |
| Effectively removes spots and stains | 72/90 | 59/82 |
| Removes old stains | 49/66** | 34/53** |
| Removes fresh stains | 77/87** | 68/86** |
| Has a powerful, deep penetrating spray | 76/97 | 60/87 |
| Does not leave a residue | 82/98 | 68/90 |
| Convenience | | |
| Is easy to use | 88/98 | 70/89 |
| Solves a problem for you | 68/90** | 62/83 |
| Is convenient to use | 90/95 | 68/89 |
| Is easy to handle | 87/96 | 69/89 |
| Has an easy to direct spray | 85/97 | 82/94 |
| Fragrance/Odors | | |
| Leaves carpet smelling clean and fresh | 54/71 | 62/85** |
| Has a pleasant scent | 49/66 | 55/78 |
| Safety | | |
| Is safe for your carpets | 80/98 | 66/86** |
| Does not discolor carpet | 90/99 | 82/94 |

*(Number of Respondents – Top Box = Strongly Agree/Top 2 Box = Strongly Agree + Somewhat Agree)
**(Number of respondents is less than 100)

TABLE 2

Cleaning Performance (%)

| | Option #1 | Option #2 |
|---|---|---|
| Complete Removal of Stains | 79 | 71 |
| Applications Needed For Effective Cleaning | | |
| Two or less | 90 | 91 |
| More than two | 10 | 9 |
| Comparison to Current Product | | |
| Better than | 50 | 52 |
| Equal to | 39 | 32 |

TABLE 3

Physical Attributes of Compositions (%)

| Amount of Foam | Option #1 | Option #2 |
|---|---|---|
| No Foam | 42 | 30 |
| Just Right | 58 | 62 |
| Too Much Foam | 0 | 8 |

Overall each embodiment of the present invention was well received by participants of the studies. High acceptance ratings on all attributes demonstrate how well the compositions of the present invention performed.

EXAMPLE 2

Product Efficacy Testing

Testing was performed in the laboratory to demonstrate the ability of the compositions of the present invention in removing common stains typically found on rugs and carpets. Cut pile 100% nylon carpet swatches (4"×4" in dimension) were used for test purposes. Liquid and semi-viscous liquids were uniformly applied consistent with standard laboratory practice. The cleaning procedure was initiated after a one hour dwell period. A second study was done where the cleaning procedure was initiated after a 24 hour dwell period. The test procedure used was as follows:

1. The product aerosol can was vigorously shaken, then product (equivalent to 6.5 grams of product) was sprayed onto the stain for 1 second.

2. The stain area was blotted with a clean, white paper towel until no visible signs of stain transfer were apparent.

3. Steps 1 and 2 were repeated a second time.

4. Treated carpet swatches were allowed to dry at ambient temperature overnight, then vacuumed using five forward and five reverse strokes with a commercial upright beater bar vacuum.

5. An internal panel of ten people assessed the appearance of the stain using the AATCC Gray Scale (see below).

| Gray Scale | Description |
|---|---|
| 5 | Negligible or no staining |
| 4 | Slightly stained |
| 3 | Noticeably stained |
| 2 | Considerably stained |
| 1 | Heavily stained |

The scale is used to compare a stain that has been cleaned against two controls: an unstained carpet swatch and a stained carpet swatch. A rating of 5 indicates that the remnants of the stain are negligible or undetectable, and a rating of 1 indicates a severe difference between the stain that has been cleaned against an unstained carpet swatch.

Results of the one hour and 24 hour studies are set forth in Table 4A and Table 4B, respectively.

TABLE 4A

Soil Removal Results - One Hour Dwell Period

| STAIN | Option #1 | Option #2 |
|---|---|---|
| Coffee | 4.2 | 3.9 |
| Cola | 5.0 | 4.8 |
| Grape Juice | 4.9 | 4.9 |
| Shoe Polish | 4.2 | 3.7 |
| Red Wine | 4.8 | 4.9 |

TABLE 4B

Soil Removal Results - 24 Hour Dwell Period

| STAIN | Option #1 | Option #2 |
|---|---|---|
| Coffee | 3.8 | 3.6 |
| Cola | 5.0 | 5.0 |
| Grape Juice | 5.0 | 4.8 |
| Shoe Polish | 3.8 | 2.2 |
| Red Wine | 4.9 | 5.0 |

Results of these two studies clearly indicate the effectiveness of the cleaning compositions of the present invention in removing stains from carpet.

A second cleaning study was performed using Option #1 cleaning composition and Option #2 cleaning composition where mud and dirty motor oil were used as the stains. The testing procedure was similar to that described above except that only a 24 hour dwell period was used. The stains were each cleaned using one application of product (7 grams), allowed to dry overnight, and then rated by a 10 person panel test. Once rated, the soiled carpet swatches were then cleaned a second time using an additional application of product (7 grams), allowed to dry overnight, vacuumed, then rated using another 10 person panel test. Results of this study are shown in Table 5.

TABLE 5

Soil Removal Results - After One and Two Product Applications

| | One Application | | Two Applications | |
|---|---|---|---|---|
| | Mud | Dirty Motor Oil | Mud | Dirty Motor Oil |
| Option #1 | 3.3 | 3.4 | 5.0 | 4.6 |
| Option #2 | 4.3 | 3.7 | 4.9 | 4.2 |

Results of this study clearly indicate the effectiveness of the cleaning compositions of the present invention at removing tough common stains typically found on rugs and carpets.

A third cleaning study was performed using Option #1 cleaning composition and Option #2 cleaning composition. For this example of cleaning performance, testing was performed by an independent testing laboratory to demonstrate the ability of both Option #1 and Option #2 cleaning compositions to remove common stains typically found on rugs and carpets. Thirteen stains were evaluated. Test material used was continuous filament, cut pile, beige color stainmaster treated carpet, 100% nylon. Liquid and semi-viscous liquids were uniformly applied in a one inch diameter ring. The balances of the staining agents were applied as uniformly as possible, consistent with standard laboratory practice. All stains were applied in duplicate. The cleaning procedure was initiated after a 24 hour dwell period. The cleaning procedure employed was as follows:

1. The stain was blotted with paper towels until no more stain could be absorbed.

2. The aerosol can containing the product to be tested was vigorously shaken for 2–3 seconds, then 7 grams of the aerosol liquid were applied to the stain.

3. The sprayed area was allowed to sit for approximately 1 minute.

4. Using a clean, white absorbent cloth or plain white paper towel, the product was blotted into the stain until no visible signs of stain transfer were apparent.

5. The cleaned area was gently wiped with clean, cool water using a clean, white, colorfast sponge, cloth or paper towel. The area was then blotted dry.

6. The test material was allowed to dry at ambient temperature and then vacuumed.

7. A panel of three technicians assessed the appearance of the stain using the AATCC Gray Scale (see earlier description).

8. Staining agents not removed to a rating of 5 were cleaned a second time. (Steps 2–7 were repeated). Results of this study are set forth in Table 6.

TABLE 6 (A)

Soil Removal 1st Cleaning Cycle Results - Outside Testing Facility

| Staining Agent | Option #1 | Option #2 |
|---|---|---|
| Mud | 5.0 | 4.5 |
| Foot Traffic Dirt | 4.8 | 4.5 |
| Coffee (Milk/Sugar) | 4.5 | 4.0 |
| Dog Urine | 5.0 | 5.0 |
| Red Wine | 4.3 | 5.0 |
| Lipstick | 3.5 | 3.8 |
| Spaghetti Sauce | 4.3 | 3.5 |
| Motor Oil - Used | 4.3 | 4.6 |
| Grease - Used | 4.3 | 3.5 |
| Ink - Black | 4.3 | 4.5 |
| Fruit Juice | 4.8 | 5.0 |
| Grape Juice | 4.8 | 5.0 |
| Shoe Polish - Black | 3.8 | 3.6 |

TABLE 6 (B)

Soil Removal 2nd Cleaning Cycle Results - Outside Testing Facility

| Staining Agent | Option #1 | Option #2 |
|---|---|---|
| Mud | 5.0 | 5.0 |
| Foot Traffic Dirt | 4.9 | 5.0 |
| Coffee (Milk/Sugar) | 4.5 | 4.5 |
| Dog Urine | 5.0 | 5.0 |
| Red Wine | 4.8 | 5.0 |
| Lipstick | 3.8 | 4.0 |
| Spaghetti Sauce | 4.5 | 4.5 |
| Motor Oil - Used | 4.8 | 4.7 |
| Grease - Used | 5.0 | 4.5 |
| Ink - Black | 4.5 | 5.0 |
| Fruit Juice | 5.0 | 5.0 |
| Grape Juice | 5.0 | 5.0 |
| Shoe Polish - Black | 4.5 | 4.8 |

Results from this study, as well as the first two cleaning studies, clearly demonstrate the effectiveness of these cleaning compositions at removing a variety of tough common stains that one could encounter on rugs, carpets and other areas and objects.

EXAMPLE 3

Product Stability Testing

Samples of both Option #1 and Option #2 were placed into stability studies utilizing 12 oz. aluminum cans equipped with an Accusol Trigger. The can stability results after one month at room temperature, 100° F., 120° F., and 130° F. showed no signs of corrosion under these conditions. The can stability results after two months and three months at room temperature, 100° F. and 120° F., showed no signs of corrosion under these conditions.

For solution stability after one month at room temperature, 100° F. and 120° F., comparison of the liquid concentrate of both options derived from the cans with that of concentrate samples that were kept under the same conditions but in glass jars (control samples) demonstrated no signs of discoloration, phase separation or precipitation.

Stability of both option formulations after three freeze/thaw cycles remained acceptable with solutions that remained clear with no visual phase separation or precipitation.

Overall, the above Examples not only demonstrate the effectiveness of the cleaning compositions of the present invention in removing stains from carpets and fabrics, but also the overall acceptance by consumers with respect to convenience, safety and fragrance.

The present invention has been described with particular reference to the preferred forms thereof. It will be obvious to one of ordinary skill in the art that changes and modifications may be made therein without departing from the spirit and scope of the present invention as defined by the following claims.

What is claimed is:

1. An aqueous aerosol cleaning composition comprising:

a solvent system;

a surfactant system having one or more amphoteric surfactants selected from the group consisting of betaine, amine oxide, alkyl imidazoline, cocaamphopropionate, alkylhydroxypropylsultane, and any combinations thereof, wherein said surfactant system is present in an amount about 0.005 wt. % to about 1 wt. %. based on the total weight of said composition;

and a propellant system, wherein the composition is non-foaming upon application to a stain.

2. The composition of claim 1, wherein said solvent system includes one or more organic solvents.

3. The composition of claim 2, wherein said one or more organic solvents are selected from the group consisting of halogenated hydrocarbon, hydrocarbon, glycol, ethylene glycol, glycol ether, propylene glycol, propylene glycol methyl ether, propylene glycol butyl ether, dipropylene glycol, dipropylene glycol methyl ether, tripropylene glycol, tripropylene glycol methyl ether, diethylene glycol butyl ether, methanol, ethanol, propanol, isopropanol, n-butanol, sec-butanol, tert-butanol, hexylcellosolve, butylcellosolve, methylcellosolve, aromatic hydrocarbon, ester, glycol ether ester, ketone, plasticizer, and any combinations thereof.

4. The composition of claim 3, wherein said one or more organic solvents are selected from the group consisting of propylene glycol monomethyl ether, propylene glycol t-butyl ether, diethylene glycol monobutyl ether, isopropanol, and any combinations thereof.

5. The composition of claim 1, wherein said solvent system is present in an amount about 2 wt. % to about 60 wt. % of the total weight of the composition.

6. The composition of claim 1, wherein said surfactant system is about 0.01 wt. % to about 0.5 wt. % of the total weight of the composition.

7. The composition of claim 1, wherein said propellant system includes one or more propellants selected from the group consisting of hydrocarbons, inorganic gases, and any combinations thereof.

8. The composition of claim 7, wherein said one or more hydrocarbon propellants are selected from the group consisting of methane, ethane, n-propane, n-butane, isobutane, n-pentane, isopentane, and any combinations thereof.

9. The composition of claim 7, wherein said one or more inorganic gas propellants are selected from the group consisting of carbon dioxide, nitrogen, nitrous oxide, and any combinations thereof.

10. The composition of claim 1, wherein said propellant system is about 5 wt. % to about 10 wt. % of the total weight of the composition.

11. The composition of claim 1, wherein said propellant system is about 7 wt. % to about 9 wt. % of the total weight of the composition.

12. The composition of claim 1, further comprising one or more enhancing agents.

13. The composition of claim 12, wherein said one or more enhancing agents are selected from the group consisting of preservative, fragrance, malodor reducing agent, salt, pH control agent, peroxygen component, soil resist, and any combinations thereof.

14. An aqueous aerosol cleaning composition comprising:

a solvent system;

a surfactant system having a nonionic surfactant selected from the group consisting of PO alcohol, copolymer, alkyl phenol, polyglycoside, n-alkylpyrrolidone, block copolymer, EO-PO alkyl phenol, nonyl phenol ethoxylate, and any combinations thereof, wherein said surfactant system is present in an amount about 0.005 wt. % to about 1 wt. %, based on the total weight of said composition; and a propellant system, wherein the composition is non-foaming upon application to a stain.

15. The composition of claim 14, wherein said solvent system includes one or more organic solvents.

16. The composition of claim 15, wherein said one or more organic solvents are selected from the group consisting of halogenated hydrocarbon, hydrocarbon, glycol, ethylene glycol, glycol ether, propylene glycol, propylene glycol methyl ether, propylene glycol butyl ether, dipropylene glycol, dipropytene glycol methyl ether, tripropylene glycol, tripropylene glycol methyl ether, diethylene glycol butyl ether, methanol, ethanol, propanol, isopropanol, n-butanol, sec-butanol, tert-butanol, hexylcellosolve, butylcellosolve, methylcellosolve, aromatic hydrocarbon, ester, glycol ether ester, ketone, plasticizer, and any combinations thereof.

17. The composition of claim 16, wherein said one or more organic solvents are selected from the group consisting of propylene glycol monomethyl ether, propylene glycol t-butyl ether, diethylene glycol monobutyl ether, isopropanol, and any combinations thereof.

18. The composition of claim 14, wherein said solvent system is present in an amount about 2 wt. % to about 60 wt. % of the total weight of the composition.

* * * * *